US005940672A

United States Patent [19]

Kagawa

[11] Patent Number: 5,940,672

[45] Date of Patent: Aug. 17, 1999

[54] FIXING DEVICE

[75] Inventor: Toshiaki Kagawa, Sakurai, Japan

[73] Assignee: Sharp Kabushiki Kaisha, Osaka, Japan

[21] Appl. No.: 09/016,133

[22] Filed: Jan. 30, 1998

[30] Foreign Application Priority Data

Mar. 19, 1997 [JP] Japan ..... 9-065724

[51] Int. Cl.[6] ..... G03G 15/20

[52] U.S. Cl. ..... 399/325

[58] Field of Search ..... 399/324, 325, 399/320, 328, 330, 331; 430/124

[56] References Cited

U.S. PATENT DOCUMENTS

| | | | |
|---|---|---|---|
| 4,378,752 | 4/1983 | Knechtel | 399/325 X |
| 4,541,707 | 9/1985 | Yoshinaga | 399/325 |
| 4,549,803 | 10/1985 | Ohno et al. | 399/325 X |
| 4,727,394 | 2/1988 | Bov, Jr. et al. | 399/325 |
| 4,870,445 | 9/1989 | Collier et al. | 399/325 |
| 5,327,204 | 7/1994 | Sculley et al. | 399/325 |
| 5,374,983 | 12/1994 | Isogai | 399/325 |
| 5,477,316 | 12/1995 | Morganti et al. | 399/324 |

FOREIGN PATENT DOCUMENTS 59-37797 10/1984 Japan .

*Primary Examiner*—Sandra Brase

*Attorney, Agent, or Firm*—Dike, Bronstein, Roberts & Cushman LLP; David G. Conlin; George W. Neuner

[57] ABSTRACT

In the fixing device with no oil leakage and a stable oil applying performance, the paper with a pre-fixed toner image is transmitted through the pressurized contact portion between a fixing roller and a pressurizing roller. An oil applying roller applied a silicon oil to the fixing roller. An oil applying felt with one end submerged to an oil tank contacts the oil applying roller. Further, in the outer side of the oil applying felt is mounted an oil collecting felt, which transmits extra oil wiped away by an equalizing member to the oil tank. The oil applying felt and the oil collecting felt is held by a felt holding plate, and is pressed towards the oil applying roller by a pressurizing spring.

23 Claims, 6 Drawing Sheets

FIXING DEVICE

TECHNICAL FIELD OF THE INVENTION

The present invention relates to a fixing device for use in an electrophotographic equipment utilizing an electrohotograph process such as copying machines, facsimile devices and printers, and especially to a fixing device for use in an electrophotographic equipment capable of a full-colored print.

BACKGROUND OF THE INVENTION

A prior art fixing device used in copying machines and printers utilize a heat roller fixing method for fixing the toner image to a recording paper by passing the paper with the pre-fixed toner image through a pair of heated and pressurized rollers to melt the toner on the paper.

However, in a heat roller fixing method described above, a so-called offset phenomenon occurs where melted toner on the recording paper adheres to the roller, which had been a problem. Especially in a colored electrophotographic equipment, the releasing characteristics of the colored toners against the roller were not good compared to prior art black toners, and the occurrence of offset phenomenon was outstanding.

Therefore, in the present fixing device of electrophotographic equipment, especially in the colored electrophotographic equipment, it is indispensable to apply an offset preventing agent having small surface energy such as silicon oil to the surface of the roller in order to prevent offset phenomenon.

Next, a typical oil applying device for use in this type of fixing devices is explained. The oil applying device comprises an oil applying roller, oil applying felt, oil control blade, oil tank, and so on. The oil applying felt is positioned so that the upper end portion thereof contacts the oil applying roller, and the lower end portion thereof is submerged to the oil inside the oil tank. By the capillary action by the oil applying felt, the oil is carried up from the oil tank and applied to the surface of the oil applying roller. The oil applied to the surface of the oil applying roller is then wiped away of the extra oil by the oil control blade pressurized against the oil applying roller by a predetermined power to equalize the oil on the roller to a predetermined amount, and then the oil is further applied to the surface of a fixing roller at a contact portion B of the oil applying roller and the fixing roller.

As is disclosed in Japanese Utility Model Publication No. 59-37797, a thin leaf spring is typically used as a means for supporting said oil applying felt and pressurizing the same against the oil applying roller. The thin leaf spring is a leaf spring having a L-shaped cross-section made of stainless steel with a thickness of 0.2 mm, and it presses the oil applying felt to the oil applying roller along the longitudinal direction of the roller while being fixed to the oil tank by a fixing means.

However, in the above-mentioned method of pressing the oil applying felt onto the oil applying roller by use of a thin leaf spring, there were the following problems:

(1) the thin leaf film is apt to bend and twist during the manufacturing process, and it is difficult to hold the oil applying felt against the longitudinal direction of the oil applying roller in a uniform manner; and (2) the thin leaf film has small freedom in determining its design by the limitation from the size of its fixing portion and for holding the felt, so the spring constant could not be set to a small amount, leading to change in the contact status of the oil applying felt and the oil applying roller by assembly errors and change in thickness of the oil applying felt by abrasion.

As a result, oil is applied unevenly, causing problems such as offset, oil stain on the end of papers, and feeding errors of papers. On the other hand, the extra oil wiped away by the oil control blade will stay at the contacting portion (portion A in the drawing) of the oil control blade and the oil applying roller, but when the device is driven for a relatively long period of time by multiple-printing and the like, the oil which could no longer stay at the contacting portion overflows and contaminates the interior of the device.

The present invention aims at solving the above problems, and provides a fixing device having a uniform and stable oil applying function which prevents occurrence of uneven application and oil stains on papers.

SUMMARY OF THE INVENTION

The fixing device of present invention comprises a fixing pressurization means for fixing a pre-fixed toner image to a recording medium by pressurizing and heating the recording medium with the pre-fixed toner image, and a release agent supplying means supplying a release agent to an application surface which is either a surface of said fixing pressurization means or a contacting surface contacting against said surface for supplying the release agent to the surface of said fixing pressurization means, wherein said release agent supplying means comprises an applying member for applying the release agent onto the application surface by contacting said surface, a holding member for holding said applying member, an application pressurization member for pressurizing the applying member onto the application surface by pressing said holding member, and a supporting member for supporting said holding member movably in the direction where the applying member separates and contacts said application surface.

In the above structure, the holding member does not need to have a function for pressing the applying member and only need to have a function for holding said applying member, so the freedom of material selection, design of forms and the like are increased. Therefore, the size accuracy of the holding member is improved compared to the prior art thin leaf spring, and a uniform contact of the applying member to the roller is realized.

Further, since the holding member is supported movably in the contacting and separating direction against the application surface and pressurized by a pressurization means, the pressurizing power will not change easily by a dispersion of the fixing position of the holding member or by the abrasion of the applying member. Therefore, a release agent application with a stable function lasting for a long period of time with only small functional differences between each manufactured products could be achieved.

Further, in the present structure, the term "application surface" means either a surface of the fixing pressurization means itself or a contacting surface of an object contacting the surface of said fixing pressurization means, and a fixing roller surface or an oil applying roller surface contacting the fixing roller, for example, is meant by this term.

In the fixing device of the present invention, said holding member is formed of a plate-shaped metal, and the surface thereof is formed to be approximately along the shape of said application surface so that said applying member contacts said application surface uniformly.

A typical application surface for applying the release agent by a release agent supplying means is formed to have a shape of a roller as is with the surface of a fixing pressurization roller and a oil supplying roller contacting thereto. However, by forming the holding member to have a shape approximately along the shape of said application surface, not only the area contacting the fixing roller and the oil applying roller is increased, but the mechanical strength of the holding member is also improved. Therefore, the strain of the holding member caused by compression is reduced, and the release agent could be applied uniformly and in a stable manner.

In the fixing device of the present invention, said applying member has an upper end portion held by said holding member, and a lower end portion inserted to a storage tank for storing said release agent, and said supporting member is a rotational supporting member supporting said holding member rotatably and being fixed on the storage tank in the area close to where said holding member is inserted.

In the above structure, the supporting member for supporting the holding member is a rotation fulcrum which is fixed on the storage tank in the area close to where said holding member is inserted, so the resistance accompanied by the movement of the applying member to or from the fixing roller and the oil applying roller is relatively small, and the pressure added to the fixing roller and the oil applying roller by the applying member is stabilized.

In the fixing device of the present invention, the applying member comprises a felt, and the pressurization power by said applying pressurization member is over 10 N and under 50 N.

By the above structure, the felt or applying member contacts the application surface by a suitable pressurization power, preventing problems such as motor disorders caused by the increase of driving torque of the fixing device, over-abrasion of the felt, and the defective contact of the felt to the roller. Therefore, a stable application of release agent could be accomplished.

The fixing device of the present invention comprises a fixing pressurization means for fixing a pre-fixed toner image to a recording medium by pressurizing and heating the recording medium with the pre-fixed toner image, and a release agent supplying means supplying a release agent to an application surface which is either a surface of said fixing pressurization means or a contacting surface contacting to said surface for supplying the release agent to the surface of said fixing pressurization means, wherein said release agent supplying means comprises a storage tank for storing said release agent, an applying member for carrying up the release agent inside the storage tank and applying said release agent to said application surface by contacting said surface, an equalizing member for equalizing the release agent applied to the application surface by said applying member, and a collecting member for collecting the extra release agent removed from the surface by said equalizing member and returning the same to said storage tank.

By the above structure, the release agent gathered to the contacting portion of the equalizing member and the roller is collected by the collecting member and returned to the tank, so even when the device is driven for a long period of time by a multiple printing and the like, extra release agent will not be gathered to the contacting portion, therefore preventing leakage of the release agent to the interior of the device.

In the fixing device of the present invention, said collecting member is positioned so that the upper end portion thereof contacts said equalizing member, and the lower end portion thereof is placed inside said storage tank not contacting the release agent.

By the above structure, the release agent could be collected effectively at the upper end portion of the collecting member, preventing reverse flow of the release agent from the tank to the collecting member.

In the fixing device of the present invention, said applying member and said collecting member each comprise of a member for carrying up said release agent by absorbing said agent and collecting said release agent by absorbing the same, and that the absorbing ability of the release agent by said applying member is lower than the absorbing ability of the release agent by said collecting member.

By the above structure, the collecting ability of the release agent by the collecting member is superior to the applying ability of the release agent to the application surface by the applying member, so the release agent wiped off at the contacting portion will be collected to the tank in a reliable manner, preventing leakage of the release agent from the contacting portion to the interior of the device.

In the fixing device of the present invention, said applying member and said collecting member are positioned having a separating member in between.

Since the applying member and the collecting member is separated by a separating member, the occurrence of problems such as the collecting ability of the collecting member being reduced by the movement of the release agent from the applying member to the collecting member could be prevented.

In the fixing device of the present invention, the fixing device further comprises a holding member for holding said applying member and said collecting member uniformly, an applying pressurization member for pressurizing said applying member onto said application surface by pushing said holding member, and a supporting member for supporting said holding member so that the applying member could be moved toward and away from said application surface.

The above structure enables to hold the applying member and the collecting member by one holding member, realizing miniaturization and lower cost of the device.

PREFERRED EMBODIMENT OF THE INVENTION

Figure 1:
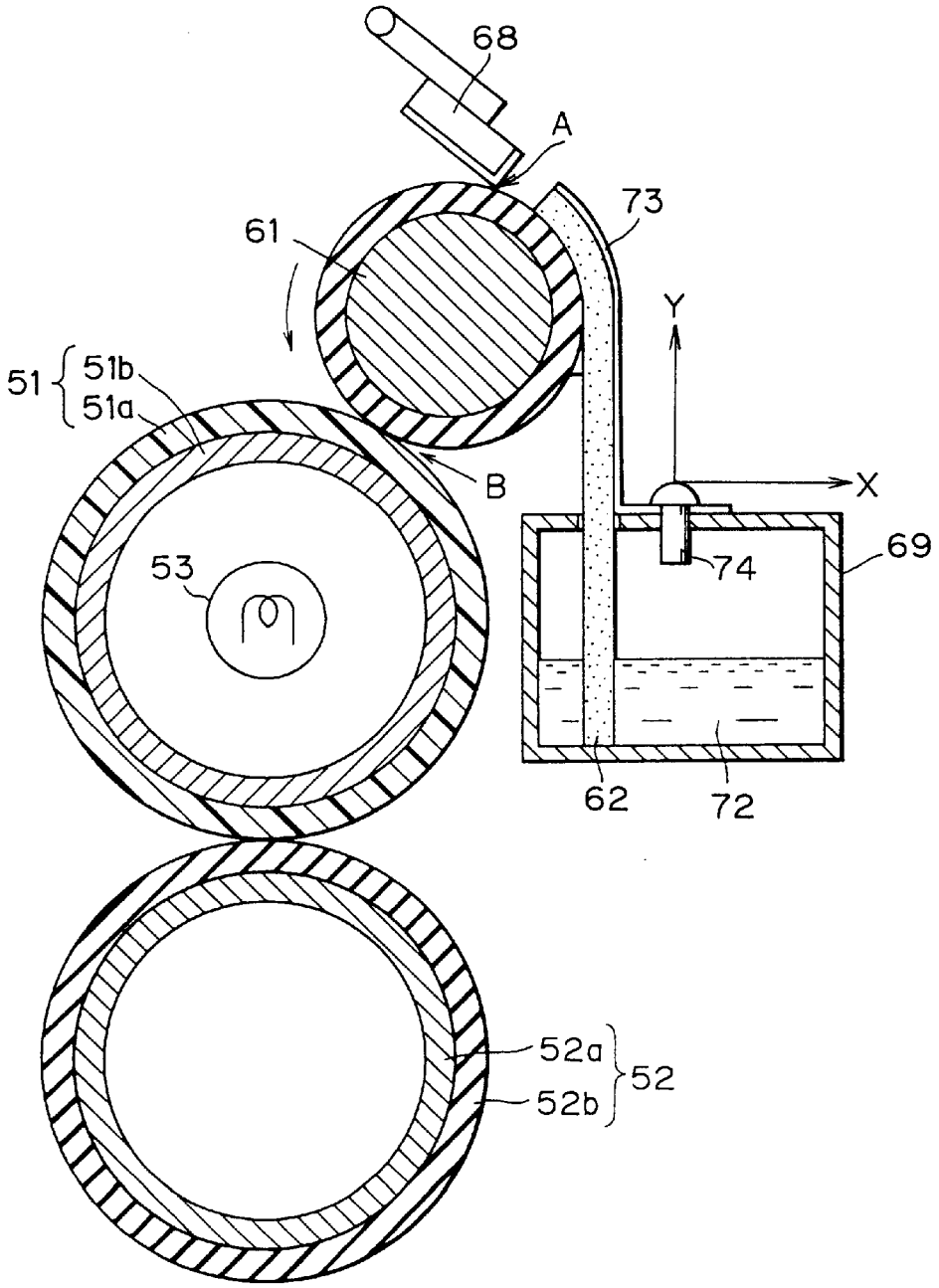
FIG.1 ( PRIOR ART )
FIG. 1 is a cross-sectional view of the fixing device of the prior art.

Prior to an explanation of the present invention, a typical prior art oil applying device for use in this type of fixing devices is explained in detail with reference to FIG. 1.

A typical prior art oil applying device comprises an oil applying roller 61, oil applying felt 62, oil control blade 68, oil tank 69, and so on. The oil applying felt 62 is positioned so that the upper end portion thereof contacts the oil applying roller 61, and the lower end portion thereof is submerged to the oil 72 inside the oil tank 69. By the capillary action by the oil applying felt 62, the oil 72 is carried up from the oil tank 69 and applied to the surface of the oil applying roller 61. The oil applied to the surface of the oil applying roller 61 is then wiped away of the extra oil by the oil control blade 68 pressurized against the oil applying roller by a predetermined power to equalize the oil on the roller to a predetermined amount, and then the oil is further applied to the surface of a fixing roller 51 at a contact portion B of the oil applying roller 61 and the fixing roller 51.

As is disclosed in Japanese Utility Model Publication No. 59-37797, a thin leaf spring 73 is typically used as a means for supporting said oil applying felt 62 and pressurizing the same against the oil applying roller 61. The thin leaf spring 73 is a leaf spring having a L-shaped cross-section made of stainless steel with a thickness of 0.2 mm, and it presses the oil applying felt 62 to the oil applying roller 61 along the longitudinal direction of the roller while being fixed to the oil tank 69 by a fixing means 74.

Below is an explanation of the embodiment of the present invention referring to FIGS. 2 through 4. In the present embodiment, a fixing device for use in a monochrome laser printer is explained.

Figure 4:
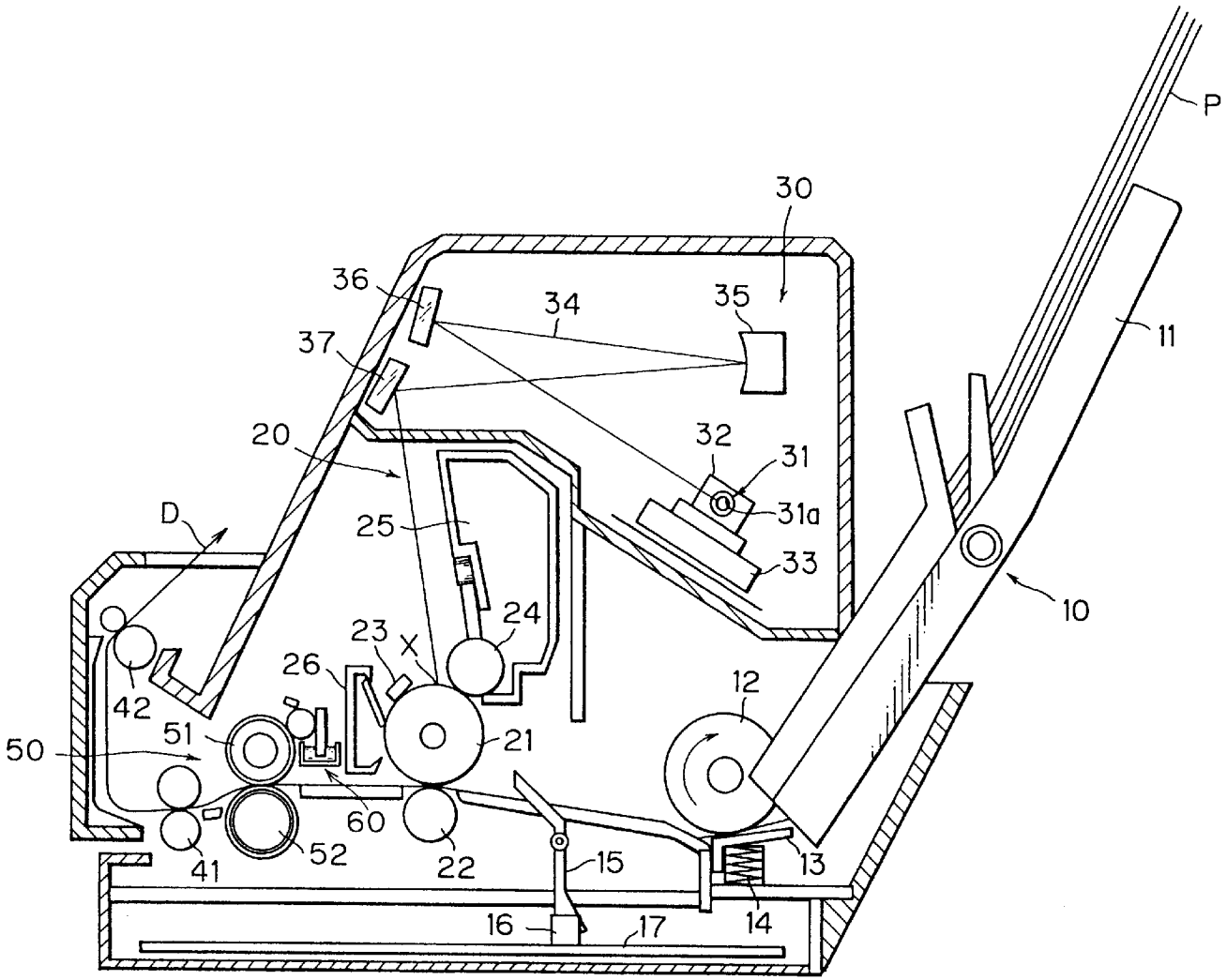
FIG. 4 is a simplified view of the structure of the laser printer comprising the fixing device of FIG. 2.

The laser printer according to the present embodiment is shown in FIG. 4 where reference 10 shows a paper feeding portion, 20 shows an image forming device, 30 shows a laser scanner, and 50 shows a fixing device.

In the laser printer with the above structure, a paper P is transmitted from the paper feeding portion 10 to the image forming device 20. In the image forming device 20, a toner image is formed based on a laser light 34 from the laser scanner 30, and said toner image is transferred to the paper P which is a transmitted recording medium. Then, the paper P with the transferred toner Image is transmitted to the fixing device 50, where the toner image is fixed to the paper P. Lastly, the paper P with the fixed toner image is discharged to the exterior of the device by paper transmitting rollers 41 and 42 mounted on the lower stream of the paper transmission. That is, the paper P is transmitted from the paper feeding tray 11 to the image forming device 20 and further on to the fixing device 50 along a path shown in the figure by an arrow D.

Said paper feeding portion 10 comprises a paper feeding tray 11, a paper roller 12, a paper separating friction plate 13, a pressurization spring 14, a paper detection actuator 15, a paper detection sensor 16, and a control circuit 17. The paper P mounted on the paper tray 11, upon receiving a printing order, feeds the paper one piece at a time into the printer by the operation of the paper roller 12, the paper separating friction plate 13, and a pressurization spring 14. The paper P being fed knocks down the paper detection actuator 15, where electric signal is outputted to the paper detection optical sensor 16, and orders to start an image printing operation. The control circuit 17 initiated by the move of the paper detection actuator 15 sends an image signal to a laser diode light-emitting unit 31 of the laser scanner 30, and controls the on/off of the light emitting diode. The laser scanner 30 comprises said laser diode light-emitting unit 31, a scanning mirror 32, a scanning mirror motor 33, and reflecting mirrors 35, 36 and 37.

The scanning mirror 32 is rotated by the scanning mirror motor 33 at a high and regular speed. That is, in FIG. 4, the laser light 34 scans the paper surface in a vertical direction. The laser light 34 irradiated from the laser diode light-emitting unit 31 is irradiated through the reflecting mirrors 35, 36 and 37 to a photo-sensitive body (drum) 21, the detailed explanation of which follows. At this time, the laser light 34 exposes selectively on the photo-sensitive body (drum) 21 based on the on/off information from said control circuit 17.

Said image forming device 20 comprises a photo-sensitive body (drum) 21, a transfer roller 22, an charging unit 23, a developing roller 24, a developing unit 25, and a cleaning unit 26. By said laser light 34, the photo-sensitive body (drum) surface being electrified by said charging unit 23 is discharged in order to form an electro-static latent image. The toner provided for the development is stored at the developing unit 25. The toner being charged inside said developing unit 25 by an agitation adheres to the surface of the developing roller 24, and by the operation of the developing bias voltage provided to the developing roller 24 and the field formed by the surface potential of the photo-sensitive body (drum), a toner image corresponding to the electro-static latent image is formed on the photo-sensitive body (drum) 21.

The paper P being transmitted from said feeding portion 10 is further transmitted between the photo-sensitive body (drum) 21 and the transfer roller 22. Then, by the operation of the field provided by the transfer voltage applied to the transfer roller 22, the toner on the photo-sensitive body (drum) 21 is transferred to the paper P, and at the same time, pre-transferred toner is collected by the cleaning unit 26.

Then, the paper P is transferred to the fixing device 50. On the surface of the fixing roller 51, a silicon oil is applied uniformly by an oil applying device 60, in order to prevent the adhesion of toner to the surface of the fixing roller 51. The paper P transmitted to the fixing device 50 is provided of a proper temperature and pressurization power by the pressurization roller 52 and the fixing roller 51 keeping a temperature of 170° C. Then, toner is melted and fixed to the paper P, providing a firm image. The paper P is transferred through the paper transmitting roller 41 and 42, and discharged to the exterior of the device.

Figure 2:
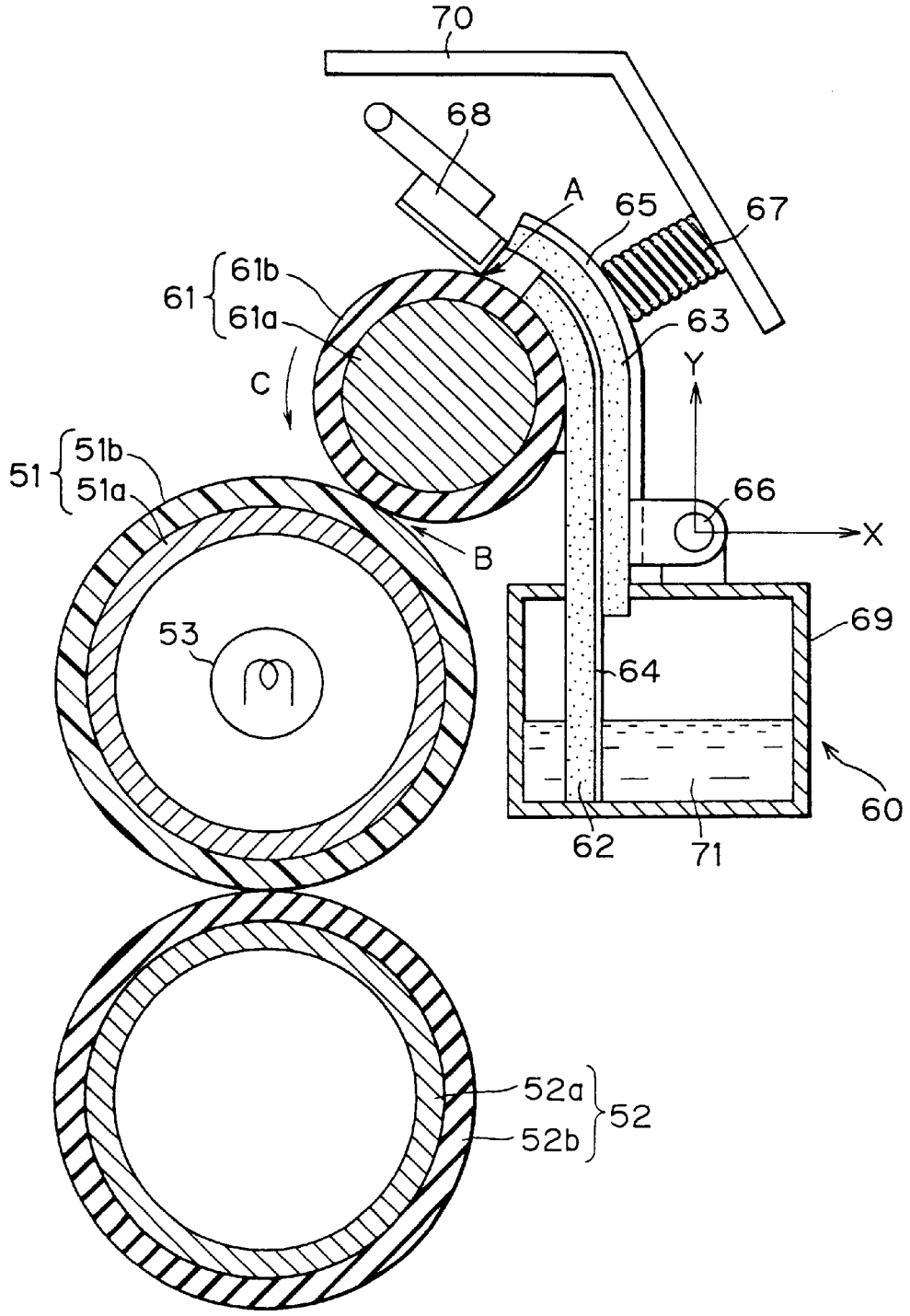
FIG. 2 is a simplified view of the structure of the fixing device according to one embodiment of the present invention.
Figure 3:
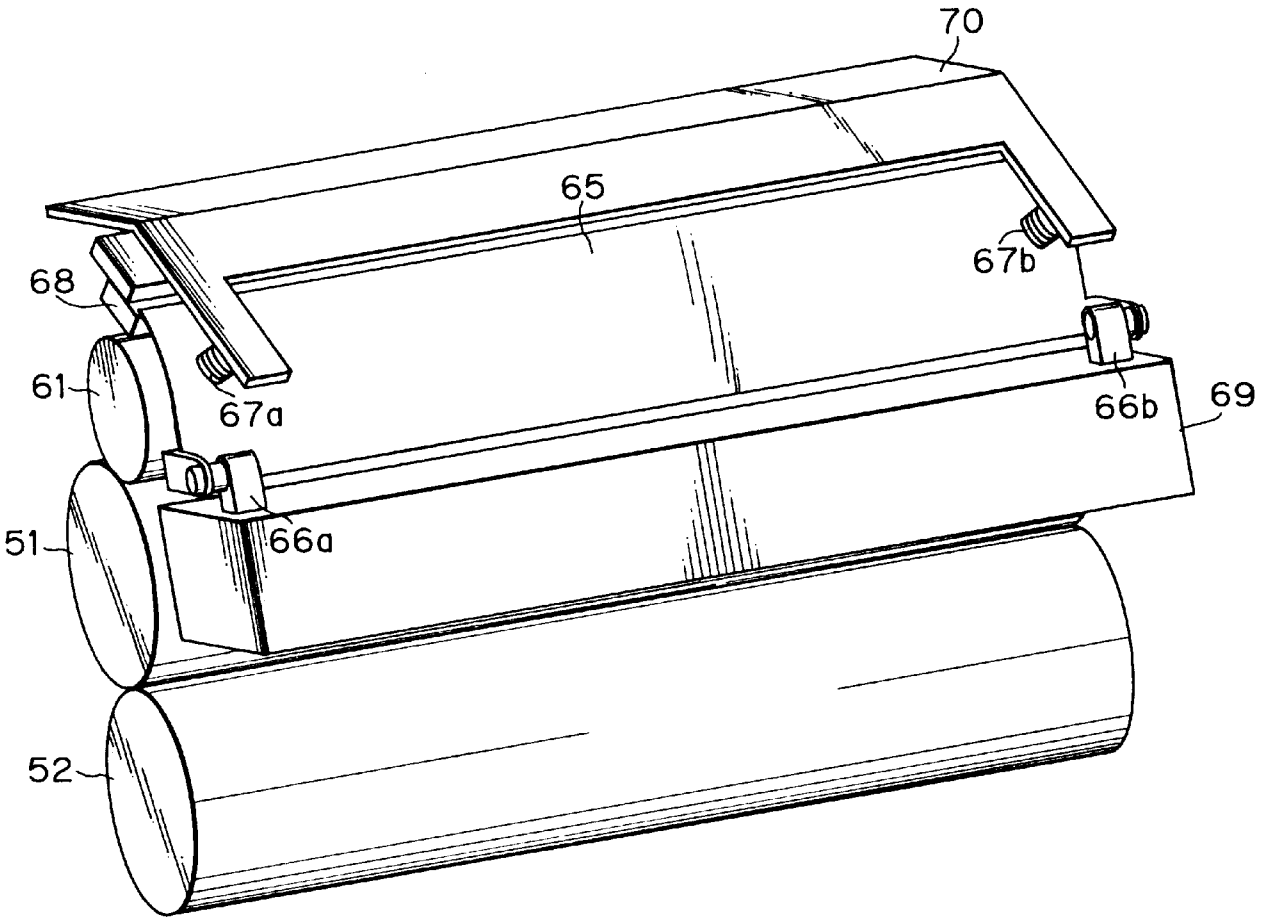
FIG. 3 is a simplified schematic view of the fixing device according to one embodiment of the present invention.

Next, the fixing device of the present invention is explained referring to FIGS. 2 and 3.

FIG. 2 is a simplified cross-sectional view of the fixing device 50 of the present invention, and FIG. 3 is a simplified cross-sectional view. The fixing roller 51 comprises a hollow core material 51*a* of aluminum, and a release layer 51*b* formed of silicon rubber covering the surface of said core material. The pressurization roller 52 comprises a core material 52*a* of stainless steel, and an elastic layer 52*b* formed of silicon rubber covering the surface of said core material, and which is pressurized by a predetermined pressure against the fixing roller 51 by a pressurization means not shown. In the interior of the fixing roller 51 is mounted a heater lamp 53, which heats the surface of the fixing roller 51 to a predetermined temperature.

The oil applying device 60 comprises an oil applying roller 61, an oil applying felt 62, an oil collecting felt 63, a felt holding plate 65, felt holding plate supporting axes 66*a* and 66*b*, pressurizing springs 67*a* and 67*b*, an oil control blade 68, an oil tank 69, and a supporting flame 70. A silicon oil 71 (product name "KF-96" manufactured by Shinetsu Kagaku Kogyo) is filled inside the oil tank 69. The oil applying roller 61 comprises a core material 61*a* of stainless steel, and a silicon rubber layer 62*b* covering the surface of the core material, which is supported so as to rotate against the supporting frame 70. Further, the oil applying roller 61 is pressurized by a predetermined pressure against the fixing roller by a pressurization means not shown, and driven to rotate at the same rotation speed as the fixing roller 51 by a driving means not shown.

The oil applying felt 62 and the oil collecting felt 63 utilizes an aromatic polyamide fiber with a thickness of 2 mm (tradename: Conex manufactured by Teijin K. K.), which is adhered together with a PET film 64 with a thickness of 0.1 mm in between. This adhered felts are held uniformly by adhering to the felt holding plate 65 formed of SPCC (cold rolling steel plate) with a thickness of 1 mm at the side of the oil collecting felt 63.

The felt holding portion of the felt holding plate 65 is formed to have a cross section of a segment shape in order to have a wide area of contact with the oil applying roller along the curvature of the surface of oil applying roller 61. The cross section of the felt holding plate 65 being in a segment shape not only widens the area of contact of the oil applying felt 62 and the oil applying roller 61, but also improves the mechanical strength of the felt holding plate 65, resulting in reduction of deformation of the felt holding plate 65 by pressure, and is further advantageous in that the contact of the oil applying felt 62 to the oil applying roller 61 is equalized.

On the lower portion of the felt holding plate 65 is an oil tank 69, and the felt holding plate 65 is supported rotatably by the felt holding plate supporting axes 66*a* and 66*b* fixed on the upper surface of the oil tank 69. The oil control blade 68 is pressurized by a predetermined pressure to the oil applying roller 61 by a pressurization means not shown. By rotatably supporting the oil applying felt 62 and positioning the fulcrum close to the inserting portion of the oil applying felt 62 on the oil tank 69, the resistance accompanied by the movement toward and against the oil applying roller 61 will be reduced, and pressurization of the oil applying felt 62 against the fixing roller 51 and the oil applying roller 61 will be stabilized.

The oil applying felt 62 is formed to have a length so that the upper end thereof contacts the oil applying roller 61 and the lower end is submerged to the oil 71 inside the oil tank 69. Further, the upper end of the oil collecting felt 63 contacts the oil control blade 67, and the lower end of the oil collecting felt 63 is inserted to the oil tank 69. However, the lower end of the oil collecting felt 63 is determined to a length so as not to contact the surface of the oil even when the oil 71 is fully filled to the oil tank 69. When the lower end of the oil collecting felt 63 contacts the oil surface, the oil inside the oil tank 69 will be sucked up by the oil collecting felt 63 by a capillary action, disabling the collecting of oil.

The felt holding plate 65 is pressurized to the direction of the oil applying roller 61 by pressurization springs 67*a* and 67*b* at the both end portions thereof as is shown in FIG. 3. As a result, the oil applying felt 62 contacts the oil applying roller 61 by a predetermined pressure.

The felt holding plate 65 is able to rotate, and since the inserting position of the oil applying felt 62 and the oil collecting felt 63 to the oil tank 69 is close to the rotational fulcrum of the felt holding plate 65, the friction of the felts 62 and 63 with the oil tank 69 and the resistance of the felt holding plate 65 when rotation resulting from the stiffness of the felts 62 and 63 are minimum, enabling a smooth rotational movement of the felt holding plate 65.

In an oil applying device having the above structure, the oil 71 sucked up from the oil tank 69 by a capillary action is applied to the surface of the oil applying roller 61. The oil 71 applied onto the oil applying roller 61 moves toward the oil control blade 68 by the rotation of the oil applying roller 61 (in the direction of arrow C in the figure). At this time, extra oil is wiped away at the contact portion A of the oil control blade 68 and the oil applying roller, and oil is uniformed to a predetermined amount. Then the oil is transferred onto the surface of the fixing roller 51 at the pressurized contact portion B of the oil applying roller 61 and the fixing roller 51. The extra oil wiped away at the contact portion A is absorbed by the oil collecting felt 63, and returned into the oil tank 69 along a PET film 64. The operation of the PET film 64 is not only to conduct the oil collected by the oil collecting felt 63 to the oil tank 69, but also to maintain the collecting ability of the oil collecting felt 63 by completely separating the oil applying felt 62 and the oil collecting felt 63. When there is no PET film 64, the oil being sucked up by the oil applying felt 62 will also be conducted to the oil collecting felt 63, so the oil collecting ability of the felt 63 will clearly be reduced.

Next, the experiment based on the present invention will be explained.

First, an experiment regarding the pressurization method of the oil applying felt is explained. As the pressurization method of the felt, two pressurization methods were performed to study the oil applying function, one case utilizing a felt holding plate 65 (made of SPCC with a thickness of 1 mm) working as the felt holding member holds the felt as was described above (refer to FIG. 2) and utilizing a pressurizing spring 67 as the pressurizing means, and the comparison case utilizing a thin leaf spring 73 (made of stainless steel with a thickness of 0.2 mm) having both the function of holding and pressurizing the felt as the felt holding member (refer to FIG. 1).

Figure 5:
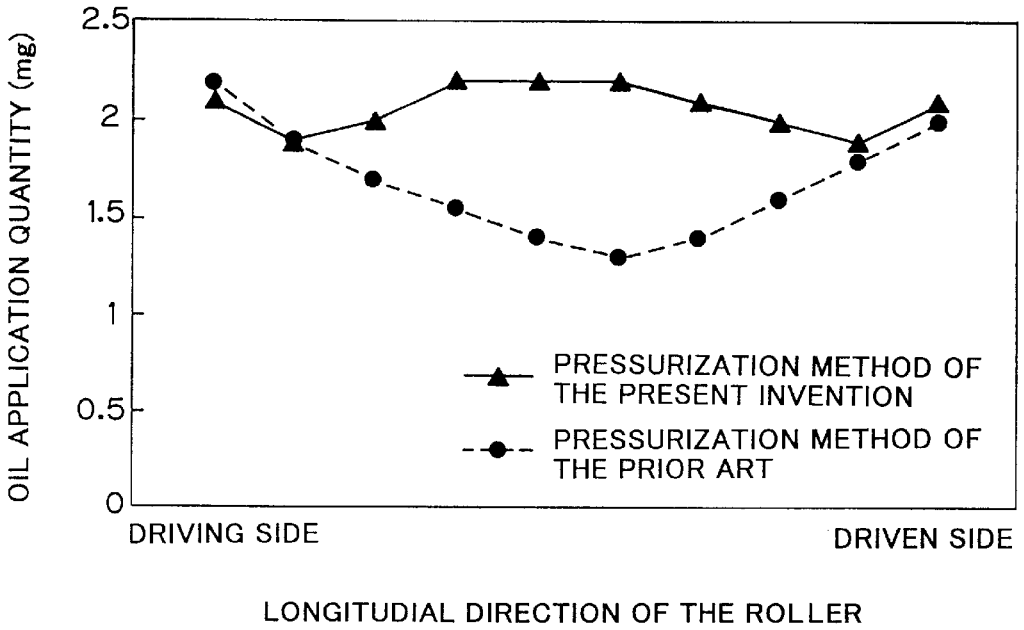
FIG. 5 is a graph showing the oil applying quantity distribution in the longitudinal direction of the fixing roller.
Figure 6:
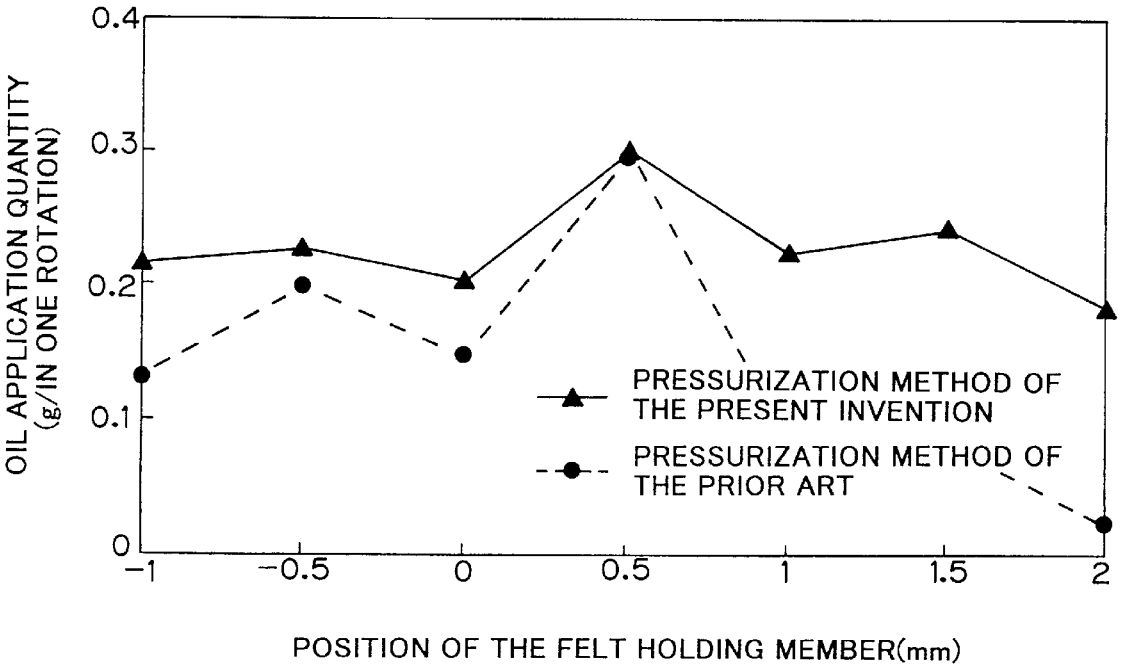
FIG. 6 is a graph showing the relationship between the mounting position of the felt holding member and the oil applying quantity.
Figure 7:
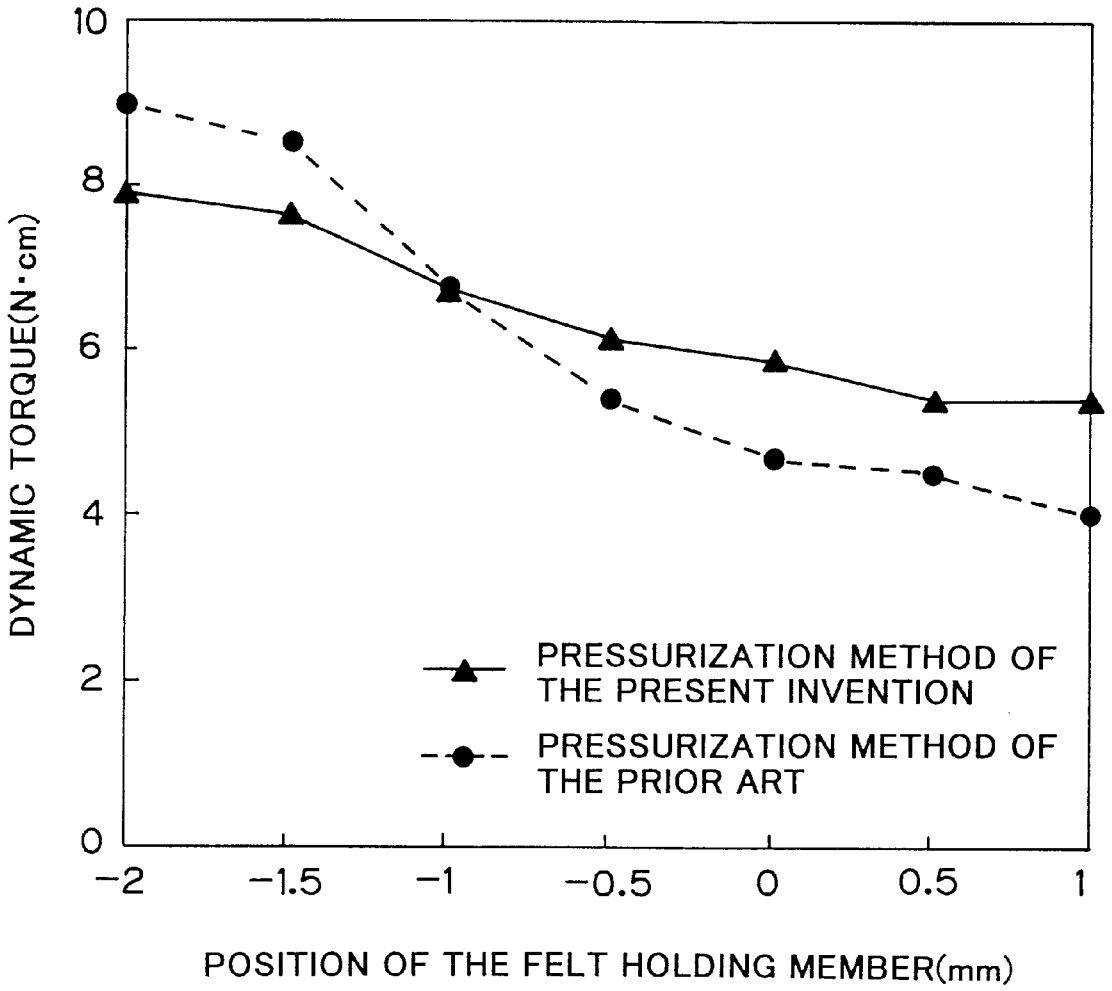
FIG. 7 is a graph showing the relationship between the mounting position of the felt holding member and the dynamic torque of the oil applying roller.

FIGS. 5 through 7 shows the result of the present experiment. FIG. 5 shows the distribution of oil application on the fixing roller. As the method of measuring the distribution of oil application, an OHP sheet divided into ten parts in the longitudinal direction of the fixing roller 51 is passed through the pressurized contact portion (hereinafter called the fixing nip portion) of the fixing roller 51 and the pressurizing roller 52, and the oil adhesion quantity is calculated from the difference. In mass of each OHP sheet before and after the measurement. The reason why an OHP sheet is utilized is because when a normal paper is utilized, it is difficult to calculate the oil adhesion quantity from the difference of the mass of the paper before and after the measurement, since the mass of paper itself differs before and after the measurement by the vaporization of water inside the paper by the heat added at the fixing nip portion. According to the result from FIG. 5, it could be noted that by the pressurization method of the prior art, the amount of oil applied in the longitudinal direction of the roller is uneven, and that the amount of oil applied at the center portion is approximately half the amount of oil being applied to the both end portions. This is because the oil applying felt 62 at the center portion does not contact the oil applying roller 61 well, since thin leaf springs are apt to warp in the manufacturing process, and in the experiment, the center portion of the leaf spring was warped in the direction away from the oil applying roller. On the other hand, in the pressurization method of the present invention, an even oil application is realized. This is because the felt holding plate 65 (the felt holding member) is made of SPCC which is easier to process than thin leaf spring, and is superior in processing accuracy with only very small amount of warp or torsion. Therefore, an even contact of the oil applying felt to the oil applying roller 61 is possible.

Next, the result on the measurement of the change of oil application quantity based on mounting errors of the felt holding member (the thin leaf spring 73 and the felt holding plate 65) is shown in FIG. 6, and the result on the experiment of the dynamic torque change of the oil applying roller 61 according to mounting errors of the felt holding member is shown in FIG. 7. The experiment method is as follows. The origin of the XY coordinate in FIGS. 1 and 2 is set to be the standard fixing position of the felt holding member. Then, the fixing position of the felt holding member is moved In an Interval of 0.5 mm from +2 mm to −1 mm in the direction shown by axis X. At each fixing position of the felt holding member, the oil applying roller was rotated, and the dynamic torque of the oil applying roller and the amount of oil applied to the oil applying roller surface (in one rotation) was measured.

From the result of FIG. 6, it could be understood that the pressurization force of the felt changes when the fixing position of the thin leaf spring 73 differs, and that the oil application quantity differs by the fixing position of the felt holding member. Especially when the position of the felt holding member 73 parts from the oil applying roller 61, oil application defect is likely to occur, and when the fixing position differs by 1 mm from the standard position, the amount of oil applied to the oil application roller 61 is almost down to 0, occurring offset in the transfer test. On the other hand, by the pressurization method of the present invention, the felt is pressurized by a pressurizing spring 67, so the pressurizing force of the felt will not rely on the mounting position of the felt holding member (felt holding plate) 65. Even when the position of the felt holding plate 65 changes, the change in pressurization force is small, therefore it could be said that the change in the amount of oil application according to the mounting position of the felt holding member 65 is small.

The same thing could be said for the dynamic torque of the oil applying roller 61 from the result shown in FIG. 7. In the prior art method, the change of torque according to the mounting position of the felt holding member 73 is large, but in the present method, the change of torque according to the mounting position of the felt holding member 65 is small.

Next, the relationship between the pressurization force of the pressurizing spring 67 and the dynamic torque of the oil applying roller 61, and the relationship between the pressurization force of the pressurizing spring 67 and the abrasion quantity of the oil applying felt 62 was studied by experiment. The result is shown in Table 1.

TABLE 1

| pressurization force (N) | oil application quantity (mg/A4) | oil applying roller dynamic torque (N · cm) | oil applying felt abrasion quantity (mm) |
|---|---|---|---|
| 5 | 14.3 | 1.5 | 0.1 |
| 10 | 18.5 | 2.3 | 0.2 |
| 30 | 20.2 | 5.8 | 0.4 |
| 50 | 21.4 | 9.0 | 0.6 |
| 70 | 22.3 | 12.1 | 1.1 |

1) The abrasion quantity of the oil applying felt is the abrasion quantity by free-roll aging corresponding to printing 60000 pieces of paper In the area where the pressurization force is over 10 N, the oil application quantity is stable at an amount of approximately 20 mg/A4. However, when the pressurization force is under 10 N, the oil application quantity is reduced to 14.3 mg/A4, and by a printing test, image flaw such as oil lines and off sets caused by oil application defect could be recognized. The reason why this occurred is thought to be that with a pressurization force of under 10 N. The contact of the oil applying felt to the oil applying roller is unstable, and partial application defects occur. By this reason, the pressurization force should be set to over 10 N from the view of oil application quantity.

On the other hand, the pressurization force should be minimum from the point of view to reduce the dynamic torque of the oil application roller and the abrasion of the oil applying felt. Especially, when the pressurization force becomes over 50 N, the abrasion of the oil applying felt becomes severe, and by a free-roll aging corresponding to printing 60000 pieces of paper, the oil applying felt having an initial thickness of 2 mm is reduced to a thickness of 0.9 mm (abrasion amount of 1.1 mm), which could no longer be used in practice. From these experiment results, the pressurization force to the felt holding member should preferably be over 10 N and under 50 N, and in the present embodiment, the pressurization force is set to 30 N.

Next, the result of studying the oil collecting performance of the oil collecting felt 63 is explained below using the experiment results.

As was explained above, the extra oil wiped away by the oil control blade 68 is collected by the oil collecting felt 63 and returned to the oil tank 69. However, when the oil collecting performance of the oil collecting felt 63 is low and the oil collecting quantity is lower than the oil being wiped away by the oil control blade 68, oil leakage will occur by continuous operation of the device. Therefore, in order to find the condition for reliably collecting the oil, the relationship between the specification (the fiber diameter and the load quantity) and the oil viscosity and the oil collecting performance was studied by experiment. The result of the experiment is shown in Table 2.

TABLE 2

| experiment No. | oil collecting felt: fiber diameter (denier) | oil collecting felt: load quantity ($g/m^2$) | oil viscosity (cs) | oil wipe quantity (g/A4) (oil control blade) | oil collect quantity (g/A4) (oil collecting felt) | oil leakage |
|---|---|---|---|---|---|---|
| 1 | 2 | 500 | 300 | 0.62 | 0.14 | X |
| 2 | 2 | 400 | 300 | 0.62 | 0.15 | X |
| 3 | 10 | 400 | 300 | 0.62 | 0.71 | O |
| 4 | 2 | 500 | 100 | 0.35 | 0.39 | O |
| 5 | 10 | 500 | 500 | 0.75 | 0.44 | X |

1) Oil applying felt specification: fiber diameter 2 denier, load quantity 500 $g/m^2$ 2) Evaluation of oil leakage was performed by continuously aging the device in the embodiment (laser printer) for 24 hours, and when leakage was found inside the printer from the fixing device, the result was X, and when it was not found, the result was O.

When the same felt (with a fiber diameter of 2 denier and a load quantity of 500 $g/m^2$) was used for the oil applying felt 62 and the oil collecting felt 63 (experiment 1), the oil wipe quantity by the oil control blade was larger than the oil collect quantity by the oil collecting felt 63, resulting in oil leakage.

Reducing the load quantity was not effective as the means for increasing the oil collect quantity of the oil collecting felt (experiment 2), but rather, increasing the fiber diameter was effective. When a felt with a fiber diameter of 10 denier was used, the oil collect quantity was larger than the oil wipe quantity, therefore preventing oil leakage (experiment 3).

Further, when the oil applying felt and the oil collecting felt have the same specification, by using an oil with a low viscosity, it was known that oil collect quantity could be increased (experiment 4).

When the oil viscosity was reduced (100 cs), the oil holding power of the oil applying roller is reduced, and as a result, the oil applied from the oil applying felt to the oil applying roller is reduced, and the oil being wiped off by the oil control blade will also be reduced. In this case, the effect of increasing the oil collecting performance is smaller than by increasing the fiber diameter of the felt in experiment 3, but the quantity of oil being wiped off is also reduced as is explained above, so the oil collect quantity is larger than the oil wipe quantity, and oil leakage could be prevented. When considering the fact that oil with viscosity of below two digits cs (dozens of cs)have high volatilization, and not only is it possible to contaminate the charging device inside the device, but also has a low flash point (an oil with viscosity of 30 cs has a flash point of less than 300° C.). From the point of safety, the lowest viscosity of the oil should preferably be 100 cs.

Further, when the viscosity of oil is over 500 cs, the oil wipe quantity will be larger than the oil collect quantity even when using an oil collecting felt 63 with a large fiber diameter (10 denier), and oil leakage occurs (experiment 5). Therefore, the upper limit of the oil viscosity should preferably be 300 Cs.

The same thing could be said when a foamed elastomer such as silicon sponge rubber is used as the applying member and the collecting member. In this case, the foam rate of the oil collecting member should be set higher than that of the oil applying member in order to prevent oil leakage. The preferable range of the oil viscosity is 100 cs through 300 cs, which is the same as when using felt.

The fixing device of the present invention comprises means for holding the applying member and means for pressurizing the applying member which is set differently. Therefore, the holding member should only have a function for holding the applying member, which leads to a more liberal choice of design and material. This increases the size accuracy of the holding member compared to the prior art thin leaf springs, and uniform contact to the roller of the applying member is realized. Further, the holding member is supported movably toward and against the roller, so the mounting flaw of the holding member or the abrasion of the applying member does not lead to change in pressurization force, and a stable application of release agent with small performance differences between products could be achieved.

Further, the present fixing device comprises an applying member for applying the release agent, an equalizing member for equalizing the release agent being applied by the applying member, and the collecting member for collecting the extra release agent being wiped off by said equalizing member. Therefore, the release agent at the contact portion of the equalizing member and the roller could be collected to the tank by the collecting member, and even when the device is driven continuously for a long period of time, extra release agent would not stay at the contact portion, preventing leakage of release agent from the contact portion to the interior of the device.

I claim:

1. A fixing device comprising:

a fixing pressurization means for fixing a pre-fixed toner image to a recording medium by pressurizing and heating the recording medium p with the pre-fixed toner image; and a release agent supplying means supplying a release agent to an application surface which is either a surface of said fixing pressurization means or a contacting surface contacting to said surface for supplying the release agent to the surface of said fixing pressurization means;

wherein said release agent supplying means comprises:

an applying member for applying the release agent onto the application surface by contacting said application surface;

a holding member for holding said applying member;

an application pressurization member for pressurizing the applying member onto the application surface by pressing said holding member; and a supporting member for supporting said holding member so that the applying member could be moved toward and away from the application surface, wherein the application pressurization member provides pressure on the release agent supplying means.

2. The fixing device of claim 1, wherein said holding member is formed of a plate-shaped metal, and the surface thereof is formed to be approximately along the shape of said application surface so that said applying member contacts said application surface uniformly.

3. The fixing device of either claim 1 or claim 2, wherein:

said applying member has an upper end portion being held by said holding member, and a lower end portion inserted to a storage tank for storing said release agent; and said supporting member is a rotational supporting member supporting said holding member rotatably and being fixed on the storage tank in the area close to where said holding member is inserted.

4. The fixing device of claim 3, wherein the applying member comprises a felt, and wherein the pressurization power by said application pressurization member is over 10 N and under 50 N.

5. The fixing device of claims 1 or 2, wherein the applying member comprises a felt, and wherein the pressurization power by said application pressurization member is over 10 N and under 50 N.

6. The fixing device of claim 1, wherein the application pressurizing member presses a rear surface of the release agent supplying means onto the fixing pressurization means.

7. The fixing device of claim 1, wherein the application pressurizing member comprises spring members.

8. The fixing device of claim 1, wherein the release agent supplying means comprises a roller member that applies the release agent onto a surface of the fixing pressurization means.

9. The fixing device of claim 1, wherein the release agent supplying means further comprises an equalizing member and wherein the release agent supplying means is positioned to continuously abut an application surface.

10. A fixing device comprising:

a fixing pressurization means for fixing a pre-fixed toner image to a recording medium by pressurizing and heating the recording medium with the pre-fixed toner image; and a release agent supplying means supplying a release agent to an application surface which is either a surface of said fixing pressurization means or a contacting surface contacting to said surface for supplying the release agent to the surface of said fixing pressurization means; wherein said release agent supplying means comprises:

a storage tank for storing said release agent;

an applying member for carrying up the release agent from the inside of the storage tank and applying said release agent to said application surface by contacting said application surface;

an equalizing member for equalizing the release agent applied by said applying member; and a collecting member for collecting the extra release agent removed from the surface by said equalizing member and returning the extra release agent to said storage tank, wherein said collecting member comprises a release-agent absorbing material.

11. The fixing device of claim 10, wherein:

said collecting member is positioned so that the upper end portion thereof contacts said equalizing member, and the lower end portion thereof is placed inside said storage tank not contacting the release agent.

12. The fixing device of claims 10 or 11, wherein:

said applying member and said collecting member each comprise of a member for carrying up said release agent by absorbing said agent and collecting said release agent by absorbing the same; and that the absorbing ability of the release agent by said applying member is lower than the absorbing ability of the release agent by said collecting member.

13. The fixing device of claim 12, wherein the viscosity of said release agent is not less than 100 CS and not more than 300 CS.

14. The fixing device of claim 13, further comprising:

a holding member for holding said applying member and said collecting member uniformly;

an application pressurization member for pressurizing said applying member onto said application surface by pushing said holding member; and a supporting member for movably supporting said holding member so that the applying member could be moved toward and away from said application surface.

15. The fixing device of claim 12, wherein a separating member is positioned between said applying member and said collecting member.

16. The fixing device of claim 15, further comprising:

a holding member for holding said applying member and said collecting member uniformly;

an application pressurization member for pressurizing said applying member onto said application surface by pushing said holding member; and a supporting member for movably supporting said holding member so that the applying member could be moved toward and away from said application surface.

17. The fixing device of claims 10, 11 or 13, wherein a separating member is positioned between said applying member and said collecting member.

18. The fixing device of claim 17, further comprising:

a holding member for holding said applying member and said collecting member uniformly;

an application pressurization member for pressurizing said applying member onto said application surface by pushing said holding member; and a supporting member for movably supporting said holding member so that the applying member could be moved toward and away from said application surface.

19. The fixing device of claims 10 or 11, wherein the viscosity of said release agent is not less than 100 CS and not more than 300 CS.

20. The fixing device of claims 10 or 11, wherein the viscosity of said release agent is not less than 100 CS and not more than 300 CS and wherein a separating member is positioned between said applying member and said collecting member.

21. The fixing device of claim 20, further comprising:

a holding member for holding said applying member and said collecting member uniformly;

an application pressurization member for pressurizing said applying member onto said application surface by pushing said holding member; and a supporting member for movably supporting said holding member so that the applying member could be moved toward and away from said application surface.

22. The fixing device of claim 10, wherein the collecting member is positioned adjacent a working position of the equalizing member.

23. The fixing device of claim 10, wherein the collecting member is positioned adjacent to a working position of the equalizing member.

* * * * *